United States Patent [19]

Deitz et al.

[11] Patent Number: 4,756,778

[45] Date of Patent: Jul. 12, 1988

[54] PROTECTING MILITARY TARGETS AGAINST WEAPONS HAVING IR DETECTORS

[75] Inventors: Victor R. Deitz, Chevy Case, Md.; Joseph P. Reardon, Saint Mary's, Pa.; Neldon L. Jarvis, Woodbridge, Va.

[73] Assignee: The United States of America as represented by the Secretary of the Navy, Washington, D.C.

[21] Appl. No.: 213,148

[22] Filed: Dec. 4, 1980

[51] Int. Cl.[4] ..... C09K 3/18; C09K 3/30; C06D 3/00

[52] U.S. Cl. ..... 149/108.2; 102/334; 252/70; 252/305; 252/503; 342/12; 423/447.5

[58] Field of Search ..... 252/305, 503, 70; 343/18 B, 18 E; 102/334; 423/439, 447.5; 149/108.2; 342/12

[56] References Cited

U.S. PATENT DOCUMENTS

| | | | |
|---|---|---|---|
| 3,150,848 | 9/1964 | Lager | 343/18 E |
| 3,221,875 | 12/1965 | Paquette | 343/18 E |
| 3,389,964 | 6/1968 | Olstowski | 423/448 |
| 3,692,577 | 9/1972 | Evans | 423/447.5 X |
| 3,754,256 | 8/1973 | Nystrom | 343/18 B X |
| 3,878,524 | 4/1975 | Olstowski | 343/18 B |
| 3,975,292 | 8/1976 | Shaffer | 252/305 |
| 4,060,435 | 11/1977 | Schroeder | 149/19.2 |
| 4,072,546 | 2/1978 | Winer | 149/19.8 |

*Primary Examiner*—Richard D. Lovering
*Attorney, Agent, or Firm*—Thomas E. McDonnell; Daniel R. Zirker

[57] ABSTRACT

Pyrolyzed carbon fibers are intercalated with alkali metal by contacting the fibers with hot metal vapors at a specified temperature to produce an infrared emissive chaff. This chaff can be released into the air to produce a heat generating cloud, which can serve as an infrared decoy or screen to protect military targets against weapons having infrared detectors. The chaff gives off a longer lasting, more moderate heat supply due to the intercalation of its active element, and is much easier to store and handle than prior art pyrophorics.

6 Claims, No Drawings

PROTECTING MILITARY TARGETS AGAINST WEAPONS HAVING IR DETECTORS

BACKGROUND OF THE INVENTION

This invention relates to the production of a chemically treated heat producing fiber, and more particularly, to the production of a intercalated graphite fiber useful as an infrared decoy or screen for protection of military targets from ordnance equipped with infrared heat-seeking detectors.

With the advent of the electronic age, modern warfare has become increasingly more and more based on complex electronic equipment. One particular group of electronic devices are the heat seeking missiles and airborne ordnance which "home in" on their desired targets by being inexorably drawn to the infrared radiation emitted by them. In most instances, the radiation emitted is generated by the engine of the target, i.e., the power plant on a warship, or an airplane's jet engines, for example. As modern electronic equipment becomes more and more sophisticated, these heat seeking weapons are becoming increasingly more accurate and difficult to avoid.

One attempt to negate these heat-seeking ordnances' effectiveness is the growth of the art of producing suitable heat generating "clouds" known as infrared emissive chaff, to function as a heat-emitting decoy which attempts to confuse the infrared seeking weapon from finding its desired target. However, designing a suitable infrared chaff has been a great problem in the art since such materials must measure up to several stringent requirements.

Materials which have been used as infrared chaff have included the following:

A. The class of solid pyrophorics which consists of finely divided solids such as white phosphorus and lithium hydroxide, and which react, upon initial exposure to the atmosphere, with the liberation of intense amounts of heat. However, these materials are extremely hazardous to store, and more seriously, produce an intense heat which lasts for but a few seconds, whereas a desirable infrared chaff should produce a moderate heat source lasting at least thirty seconds or more.

B. Eutectic chaffs, such as solids like barium hydroxide, undergo a phase transition near ambient temperatures, with the resulting liberation of heat. However, these materials have the draw-back that the quantity of heat liberated per unit weight of material is insufficient for the desired use.

C. Pyrophorics which are dissolved in a solvent and then applied as a solution on an absorptive solid such as paper or a textile fiber. Suitable materials are the trialkylaluminums and the organosilanes, and they can be diluted to the extent of providing a measure of control over the pyrophoricity of the resultant chaff. However, these materials are hazardous to handle, decompose during storage, and are also hampered in their effective dispersal into the atmosphere by the capillary forces of the liquid solvent.

It is, accordingly, an object of the present invention to provide an infrared chaff that supplies a suitable amount of heat for up to one minute duration, and ameliorates the hazards inherent in storage of the material.

It is a further object of the invention to produce an infrared chaff which does not decompose during storage, can be designed to give off heat and radiation of a desired temperature, and further functions as a radar and radio-frequency reflective chaff.

These and other objects, advantages and novel features of the invention will become apparent from the following detailed description of the invention.

SUMMARY OF THE INVENTION

This invention involves the production of an infrared-emissive chaff which can function as a decoy against heat seeking missiles and other airborne ordnance, made from a plurality of pyrolyzed high-aspect-ratio graphite fibers saturated with an intercalated alkali metal or combinations of intercalated alkali metals. The intercalation of the alkali metal(s) within the graphitic structure of the carbon fibers provides a reaction "timer", due to the heat generating reaction being able to proceed governed by the rate the molecules of oxygen and water can diffuse into the tight crystal lattices of the graphitic structure in order to contact and react with the intercalated alkali metal. The chaff is produced by pyrolyzing carbonaceous base materials in an inert atmosphere at a temperature of 1200°-3000° C., followed by heating the metals and allowing their vapors to contact the carbon fibers in an inert atmosphere until a desired amount of intercalation within the graphite lattice occurs.

The invention also consists of a method of use of the plurality of intercalated graphite fibers for protection of military apparatus, particularly warships, from infrared-seeking airborne ordnance. The method comprises the steps of keeping a suitable amount of the intercalated fibers available, and upon attack releasing the infrared emissive chaff into the air, whereupon the fibers react with the oxygen and water in the atmosphere to release a long-lasting heat source of the magnitude of the radiation emitting from the military target for a desired time interval.

DESCRIPTION OF THE INVENTION

An essential element of this invention is the inclusion of a built-in pyrophoric "timer" within the infrared emissive chaff. This is so because the crystalline structure of graphite approximates a series of substantially parallel planes of carbon atoms having narrow spaces between each plane of the graphitic carbon. The concept behind this particular chaff is to store within this crystalline graphite lattice a significant amount of alkali metals, such as either Na, K, or Rb samples, mixtures of these various elements, or combination of alkali metals like NaK, or the like, either alone or in mixtures with individual alkali metals. These metals react with the $O_2$ and $H_2O$ present in the atmosphere to give off significant amounts of heat, with resulting emanation of infrared radiation (heat). The alkali metals are processed to deposit in the spaces between these crystalline graphite planes, i.e., "intercalate" between the graphite planes to form a type of coordination compound. The macroscopic consequences of such a molecular arrangement are that a reaction "timer" is, in effect, constructed, since the reaction can proceed only gradually, due to the fact that the $O_2$ and $H_2O$ molecules must first diffuse into the tight crystal lattices of the graphitic regions in order to contact and react with the intercalated alkali metal. Thus the intensity and duration of the infrared radiation is controlled by the rate of diffusion of $O_2$ and/or $H_2O$ into the graphitic lattice.

The infrared emissive chaff of the invention is preferably prepared in the following manner: First, a plurality of suitable carbon fibers are prepared by pyrolyzing base materials such as petroleum pitch or certain textile fibers, e.g., polyacrylonitrile and viscose rayon, or the like, in an inert gas atmosphere at temperatures ranging from about 1200°-3000° C., with the preferred temperature being around 3000° C. The pyrolyzed carbon structure may be examined with x-ray equipment to see if the desired graphitic crystalline structure has formed and if the fibers themselves have a high-aspect-ratio. In these fibers there exist tiny domains of graphite-like structure, within which certain chemical species can insert or intercalate themselves to form a type of coordination compound between the graphitic carbon and the intercalated species. Also, although the alkali metal present is chiefly intercalated, a minor amount of absorbed alkali metal can exist in the non-graphitic regions of the carbon fiber.

The preferred method of intercalating the alkali metal within the carbon fiber is to heat the metal(s) at a temperature range of about 250°-500° C. (Rb @250°-500° C.; Na, K @400°-500° C.) until a measurable vapor pressure, about 4 mm, is created. The reaction takes place in either a vacuum vessel or under a stream of inert gas, (the noble gases with Argon the preferred) thus allowing the hot metal vapors to flow over the fibers. The extent of the reaction, that is, the degree of intercalation chosen, can be controlled by adjusting the time of the reaction (1-10 hours is the preferred range), the quantity of alkali metal used, and the temperature (200°-500° C.) of the contacting metal. The various stages of completion of intercalation are clearly indicated by the color of the carbon fibers, hues of metallic blue indicating various intermediate stages of completion, while a lustrous gold signifies the saturation of the fibers. The degree of intercalation reached depends upon the precise type of high-aspect-ratio carbon fiber used and the heat required for a particular application. When the desired stage of intercalation is reached, the fibers are preferably sealed in an inert atmosphere, such as the container in which the reaction occurred. Later, as the need arises, the fibers can be rapidly released into the air by exploding the container with a small charge, whereupon they immediately react with the atmosphere to produce infrared radiation. The duration of the heat can be in excess of one minute where desired, and can be processed to emit heat of the intensity of the heat source it is trying to protect by a judicious choice of alkali metals, reaction times and temperatures.

This invention also includes a method of use of the plurality of intercalated pyrolyzed carbon fibers for the protection of military apparatus, particularly naval warships and airplanes. The method comprises the steps of storing the processed fibers in a suitable container, upon being attacked by heat seeking airborne ordnance, releasing the chaff into the air, whereupon the fibers react with the $O_2$ and $H_2O$ present in the atmosphere to produce an infrared source of the magnitude of the radiation given off by the prospective target (i.e., 200°-500° F.) for a desired time period of about 30 to 90 seconds, and preferably in excess of one minute. The intercalated fibers should give off a heat 200°-500° F. and preferably about 300° F. if it is desired to confuse a missile seeking a ship, since this temperature approximates the hottest part of a typical naval warship.

There are also other advantages to be obtained by using this chaff in the manner described, supra. In contrast to the chaffs made by the absorption of a dissolved pyrophoric onto a porous substance, there are no capillary forces arising from the presence of a liquid phase to interfere with the effective dispersal of the chaff. In contrast to the eutectic chaffs, the intercalated chaffs can be tailored to a given need by varying the amount of metal intercalated and by choosing the high-aspect-ratio carbon fibers from among the wide variety available. Further, the technology for the safe handling of the alkali metals is well established, which is a significant factor in reducing the hazards inherent in all pyrophoric materials. Also, due to the high-aspect-ratio and electrical conductivity of the fiber, the fiber chaff when cut to the proper sizes, can also function as a radio-frequency reflector, in addition to its infrared-emissive properties.

Alternative materials to carbon fibers include the various types of graphites, e.g., flakes of pyrolytic or minerological graphite, for example. Similarly, other intercalating agents besides the various combinations of alkali metals can be used, specifically any substance which can intercalate graphite and also produce a highly exothermic reaction with the atmosphere, such as anhydrous aluminum chloride, for example.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method of protecting military targets from ordnance equipped with heat seeking infrared detectors comprising:

supplying said military targets with a suitable plurality of pyrolyzed graphite fibers intercalated by an intercalation agent selected from at least one of the alkali metals, and combination of alkali metals;

releasing said plurality of pyrolyzed graphite fibers into the atmosphere while under attack from said ordnance;

wherein said plurality of pyrolyzed graphite fibers react with the atmosphere to release a long-lasting heat generating cloud which functions as an active infrared decoy so as to confuse said ordnance.

2. A method as claimed in claim 1 wherein said military targets are naval warships.

3. A method as claimed in claim 1 wherein said plurality of pyrolyzed graphite fibers are made from carbonaceous base materials processed at a temperature of 1200°-3000° C. in an inert atmosphere.

4. A method as claimed in claim 1 wherein said plurality of pyrolyzed graphite fibers, upon release into the atmosphere, react with the $O_2$ and $H_2O$ in the atmosphere to release an infrared-emissive heat source of a temperature of 200°-500° F. for a period of about 30 to 90 seconds.

5. A method as claimed in claim 4 wherein said plurality of pyrolyzed graphite fibers, upon release into the atmosphere, react with the $O_2$ and $H_2O$ in the atmosphere to release an infrared emissive heat source of a temperature of about 300° F. for a period 30 to 90 seconds.

6. A method as claimed in claim 5 wherein said plurality of pyrolyzed graphite fibers, upon release into the atmosphere, react with the $O_2$ and $H_2O$ in the atmosphere to release an infrared emissive heat source of a temperature of about 300° F. for a period of about 60 to 90 seconds.

* * * * *